US007121325B2

(12) United States Patent
Krüger et al.

(10) Patent No.: US 7,121,325 B2
(45) Date of Patent: Oct. 17, 2006

(54) HEAT EXCHANGER

(75) Inventors: Uwe Krüger, Bietigheim-Bissingen (DE); Rainer Lutz, Bissingen (DE); Martin Schindler, Stuttgart (DE); Michael Schmidt, Karlsruhe (DE)

(73) Assignee: BEHR GmbH & Co., Stuttgart (DE)

( * ) Notice: Subject to any disclaimer, the term of this patent is extended or adjusted under 35 U.S.C. 154(b) by 0 days.

(21) Appl. No.: 10/682,846

(22) Filed: Oct. 10, 2003

(65) Prior Publication Data

US 2004/0188070 A1 Sep. 30, 2004

(30) Foreign Application Priority Data

Oct. 14, 2002 (DE) ..... 102 47 837

(51) Int. Cl.
*F02M 25/07* (2006.01)
*F28F 9/02* (2006.01)

(52) U.S. Cl. ..... 165/51; 165/158; 165/174; 165/134.1; 60/320; 123/568.12

(58) Field of Classification Search ..... 165/51, 165/174, 158, 134.1; 60/320; 123/568.12
See application file for complete search history.

(56) References Cited

U.S. PATENT DOCUMENTS 1,745,492 A * 2/1930 Kelch et al. ..... 165/51
3,201,938 A 8/1965 Zinin
3,552,487 A * 1/1971 Tokumitsu et al. ..... 165/174
4,173,615 A * 11/1979 Otsuka et al. ..... 422/197
4,621,677 A 11/1986 Suzuki et al.
4,685,292 A * 8/1987 Brigham et al. ..... 60/320
4,903,760 A 2/1990 Joshi et al.
6,128,821 A * 10/2000 Grescher ..... 29/890
6,311,678 B1 11/2001 Lepoutre
6,595,274 B1 * 7/2003 Hayashi et al. ..... 165/158
6,684,938 B1 * 2/2004 Tsujita et al. ..... 165/51

FOREIGN PATENT DOCUMENTS

| | | | |
|---|---|---|---|
| DE | 3419442 | C2 | 11/1986 |
| DE | 4431135 | C2 | 3/1996 |
| DE | 101 44 827 | A1 | 3/2003 |
| EP | 0 138 677 | A2 | 4/1985 |
| EP | 0 149 466 | B1 | 7/1985 |
| JP | 11280564 | A * | 10/1999 |

* cited by examiner

*Primary Examiner*—John K. Ford
(74) *Attorney, Agent, or Firm*—Foley & Lardner LLP

(57) ABSTRACT

A heat exchanger, in particular an exhaust gas heat exchanger for a motor vehicle, has tubes through which a first fluid can flow and around which a second fluid can flow, and a headpiece. The headpiece includes a dual-walls structure in at least a part thereof and a distribution chamber that communicates with the tubes.

4 Claims, 3 Drawing Sheets

HEAT EXCHANGER

CROSS-REFERENCE TO RELATED PATENT APPLICATIONS

Federal Republic of Germany Priority Application 102 47 837.6, filed Oct. 14, 2002, including the specification, drawings, claims and abstract, is incorporated herein by reference in its entirety.

FIELD OF THE INVENTION

The invention relates to a heat exchanger, in particular an exhaust gas heat exchanger for a motor vehicle, having tubes and having a headpiece.

BACKGROUND OF THE INVENTION

It is known for exhaust gas to be fed back to an internal combustion engine, in order to reduce emissions from the internal combustion engine. Owing to the high exhaust gas temperatures, the exhaust gas is first of all passed through a heat exchanger, which is in the form of an exhaust gas cooler, in order to cool the exhaust gas down to a temperature level which is good for combustion.

DE 197 50 588 A1 describes an apparatus for exhaust gas feedback for an internal combustion engine which has an exhaust gas cooler such as this. The exhaust gas cooler in this document has an elongated shape, and, at each of its ends, has a header plate in which the ends of a large number of tubes are inserted, which are arranged at a distance from one another. The tube bundle that is formed in this way is surrounded by a casing which is provided with connections through which the coolant is fed in and out.

The header plate at one end of the exhaust gas cooler is connected to a distribution chamber or header which tapers approximately in the form of a funnel and communicates with a large number of tubes. On the side opposite the header plate, the distribution chamber merges into a flange, which is connected to an exhaust gas pipe that further continues.

When a hot fluid is passed into the distribution chamber during operation of heat exchangers such as these, from where it flows into the tubes, the distribution chamber or a wall which surrounds the distribution chamber is heated to a greater extent than, for example, the casing which surrounds the tube bundle and through which coolant flows. The resulting thermal stresses between the distribution chamber wall and the casing in some circumstances cause leaks, in particular, at a contact point between the distribution chamber wall and the casing. Such leaks have a negative influence on the life of the heat exchanger.

SUMMARY OF THE INVENTION

It is an object of the invention is to provide a heat exchanger that ensures reliable operation, and possibly better operation. Another object of the invention is to provide an improved exhaust system in a vehicle.

In accomplishing the foregoing objects, there has been provided according to one aspect of the present invention a heat exchanger comprising tubes through which a first fluid can flow and around which a second fluid can flow, and a headpiece in which a distribution chamber that communicates with the tubes is located, wherein at least a portion of the headpiece has an inner wall and an outer wall.

In accordance with another aspect of the invention, there has been provided a vehicle exhaust system, comprising: an exhaust conduit for transporting exhaust gases from an internal combustion engine; and a heat exchanger connected to the exhaust conduit for receiving exhaust gases, wherein the heat exchanger comprises a heat exchanger as defined above.

Further objects, features and advantages of the invention will become apparent from the detailed description of preferred embodiments that follows, when considered together with the accompanying figures of drawing.

DETAILED DESCRIPTION OF THE PREFERRED EMBODIMENTS

Figure 1:
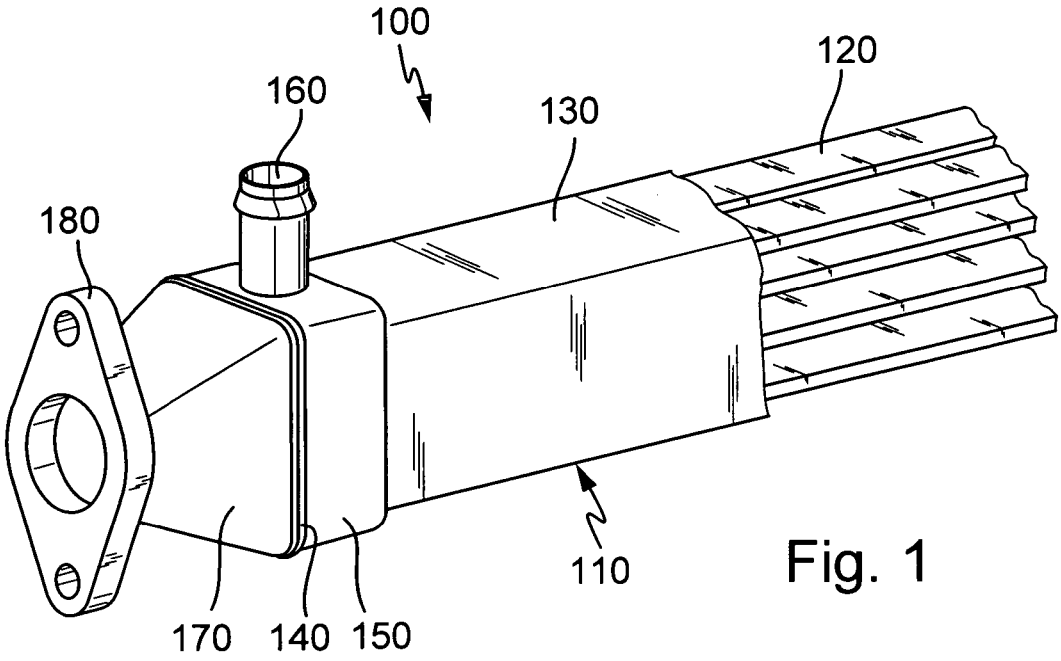
FIG. 1 is a perspective view of a heat exchanger.

A heat exchanger according to one aspect of the invention has tubes which form a tube block, through which tubes a first fluid can flow and around which tubes a second fluid can flow, in order that heat can be transferred from the first fluid to the second fluid, or vice versa. The heat exchanger also has a headpiece (header or manifold) in which a distribution chamber that communicates with the tubes is located, in order that the first fluid can be distributed between the tubes. The headpiece has a dual wall structure comprising an inner wall and an outer wall, at least in a portion thereof.

The invention reduces direct heat transmission from the first fluid flowing into the distribution chamber to the contact area between the headpiece and the tube block. This is achieved in that the temperature difference between the headpiece in the contact area and the tube block during operation of the heat exchanger is less than in the case of a headpiece that has only one wall, so that the thermal stresses between the headpiece and the tube block are reduced.

The inner wall of the present invention may comprise, for example, a guide plate, which can be inserted into a conventional headpiece. An outer wall may then be formed by the conventional headpiece. A gap or cavity which occurs between the inner wall and the outer wall provides thermal isolation between the inner wall and the outer wall, and hence also between the distribution chamber and the outer wall, so that reduced thermal stress and more reliable operation are achieved in a very simple manner.

Heat, of course, is conducted from the inner wall to the outer wall via attachment points between the two walls. According to one preferred embodiment, the inner wall therefore is attached to the outer wall in an area of the headpiece that faces away from the tubes, so that the heat conduction path from the inner wall to the outer wall is enlarged in the contact area between the headpiece and the tube block, thus reducing the heat transmission from the fluid flowing into the distribution chamber to the contact area. Particularly in the case of very hot fluids, it is advantageous to provide a heat-resistant connection, such as a welded joint, between the inner wall and the outer wall.

According to one preferred feature of the invention, the inner wall and the outer wall are supported with respect to one another by supporting means, in order to prevent the inner wall from moving backwards and forwards with respect to the outer wall. More preferably, the supporting means are integrated in the inner wall and/or in the outer wall as stud-like embossed areas, as a circumferential or interrupted rib or ribs, or as shaped attachments, thus allowing a simple, and hence low-cost, design.

According to another feature of the invention, a channel which is formed between the inner wall and the outer wall can have a third fluid applied to it via an inlet opening in the outer wall. In this case, the channel may have any desired shape, but for space reasons a flat channel along one inner wall of the outer wall is advantageous.

At least the outer wall can additionally be cooled by the third fluid, so that the contact area between the headpiece and the tube block is thermally even better decoupled from the first fluid flowing into the distribution chamber. This provides an even better capability to avoid thermal stresses between the headpiece and the tube block, and leaks associated with them.

According still another feature of the invention, the third fluid can be passed through the channel into the distribution chamber and/or into the tubes. The mixing of the first fluid and third fluid associated with this in the heat exchanger allows additional heat transmission and hence a better performance of the heat exchanger. However, this feature is dependent on functional compatibility between the first fluid and the third fluid, for example, with the third fluid being the same as the first fluid, and with the third fluid having a pressure level which is at least as great as that of the first fluid in the distribution chamber, since the first fluid would otherwise emerge from the heat exchanger through the channel.

It is also preferable for the first fluid to be an exhaust gas from an internal combustion engine, and for the third fluid to be air. Since the exhaust gas temperatures are normally high during operation, the effect according to the invention, i.e., reducing the heat transmission or the temperature differences, is particularly great and advantageous in a so-called exhaust gas heat exchanger such as this.

In yet another embodiment, the third fluid can be passed out of the channel through an outlet opening in the outer wall. The channel can thus be integrated in a closed circuit, for example in a cooling circuit, thus allowing the outer wall to be cooled in a simple manner using existing apparatus, such as the engine cooling circuit.

It is preferable for the third fluid to be the same as the second fluid, in particular a coolant, as a result of which the headpiece can be cooled before or after the cooling of the tube block.

The invention will be explained in more detail in the following text using exemplary embodiments and with reference to the drawings.

FIG. 1 shows a cutaway illustration of a heat exchanger 100, which can be used as a coolant-cooled exhaust gas cooler. The heat exchanger 100 comprises a tube block 110, which is composed of a large number of tubes 120 and a casing 130. The tubes 120, which are at a distance from one another, are inserted at the ends of the tube block 110 into tube header plates. All of the tubes that ordinarily can be seen from the outside is a circumferential edge 140. In order to hold the tubes 120, the casing 130 is itself tubular and, in its end areas, has circumferential chambers 150 which are provided with connections 160 for a coolant.

A headpiece 170, which is approximately in the form of a funnel, is inserted and welded into the circumferential edge 140 of one header plate, so that a distribution chamber (which cannot be seen) in the headpiece 170 communicates with the tubes 120. On the side opposite the header plate edge 140, the headpiece merges into a flange 180, which can be connected to an exhaust gas pipe (not illustrated).

If an exhaust gas mixture coming from an internal combustion engine flows through the flange 180 into the distribution chamber, the headpiece 170 is severely heated since the exhaust gas temperatures are normally high. The exhaust gas then flows through the tubes 120, where it can emit heat to the tube walls. The exhaust gas is then collected in a further headpiece, and is passed out of the essentially symmetrical exhaust gas coolant. The circumferential chamber 150 of the casing 130 has a coolant applied to it via the connection 160, from the cooling circuit of the internal combustion engine, in order that the coolant can flow around the tubes 120 and can absorb heat from the tube walls, after which the coolant is passed out of the exhaust gas coolant via a further connection.

Figure 2:
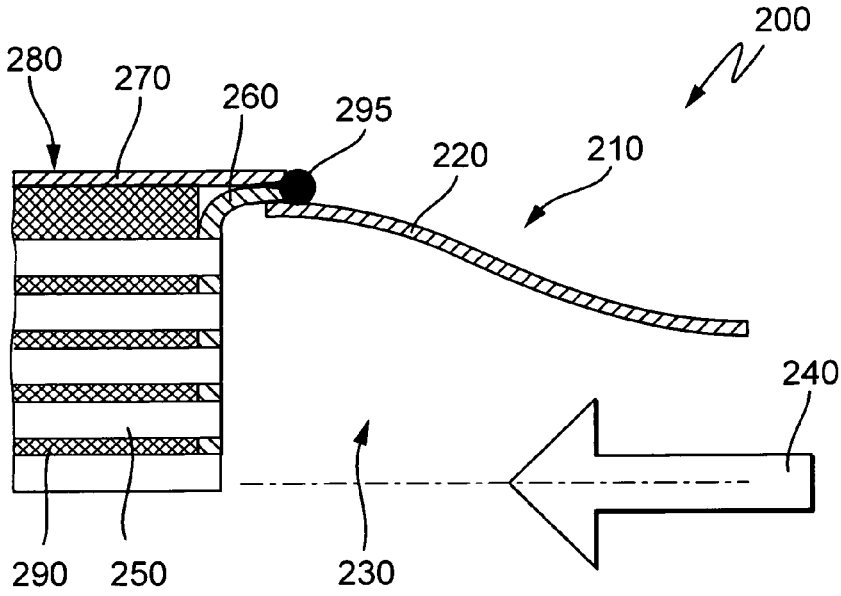
Fig. 2 (PRIOR ART)
FIG. 2 is a cross-sectional view of a heat exchanger according to the prior art.

In an exhaust gas cooler 200 according to the prior art, a detail of which can be seen in the form of a section in FIG. 2, the headpiece 210 has one wall 220, which is very severely heated during operation of the exhaust gas cooler 200 as a result of direct contact with the hot exhaust gas flow 240 which flows into the distribution chamber 230. In contrast to this, the tube block 280 that comprises the tubes 250, the header plate 260 and the casing 270 is cooled directly by the coolant 290, so that the tube block 280 is heated to a far lesser extent than the wall 220 of the headpiece 210.

The thermal stresses that occur as a result of the different thermal expansions of the tube block 280 and of the headpiece 210 mechanically load the weld seam 295, which connects the casing 270 and the header plate 260 to the wall 220 on the headpiece 210. This can lead to leaks in the area of the weld seam 295, and thus to shortening of the life of the exhaust gas cooler 200.

Figure 3:
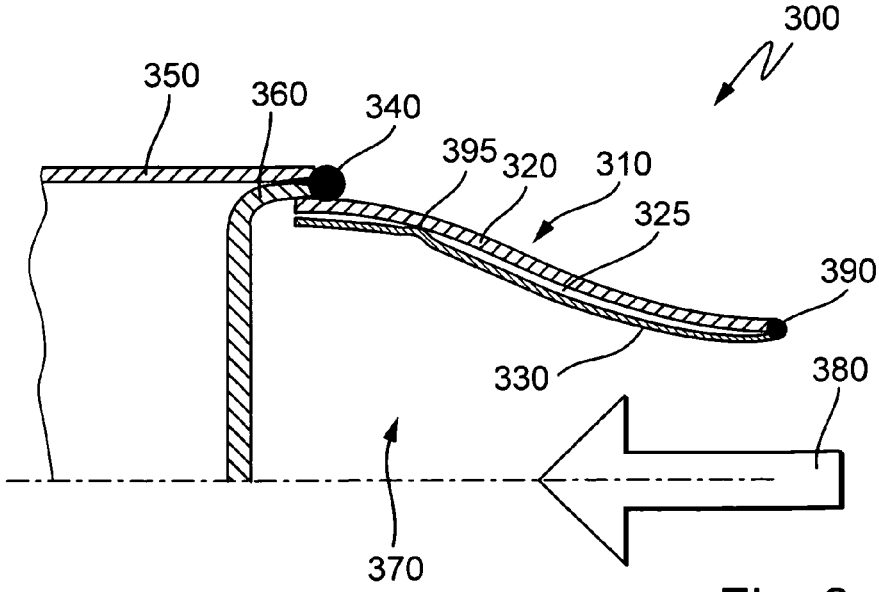
FIG. 3 is a cross-sectional view of a heat exchanger according to one embodiment of the present invention.

FIG. 3 is a cross-sectional view of a heat exchanger 300 according to one preferred embodiment of the present invention. In this case, the headpiece 310 comprises an outer wall 320 and an inner wall 330 that is in the form of a guide plate, between which a cavity 325 in the form of a gap is formed. During manufacture of the exhaust gas cooler 300, the guide plate 330 is inserted and welded into the outer wall, although other attachment methods are also feasible.

The guide plate 330 prevents the exhaust gas 380 that flows into the distribution chamber 370 from flowing directly over the contact point 340 between the outer wall 320 and the tube block 350 or the header plate 360. The cavity 325, which is in the form of a gap, is used to a certain extent to provide thermal isolation between the distribution chamber 370 and the contact point 340, so that the outer wall 320 as well as the contact point 340 are heated less severely by the exhaust gas flow 380. This reduces thermal stresses between the headpiece 310 and the tube block 350, and reduces the risk of leaks.

The inner wall 330 and the outer wall 320 can be attached to one another, in particular welded to one another, at two or more points. In the exemplary embodiment shown in FIG. 3, the walls 320, 330 are advantageously welded to one another only in an area 390 which faces away from the tube block 350, in order to slow down as much as possible heat conduction from the guide plate 330 to the contact point 340 within the material of the headpiece 310.

In order to prevent the guide plate 330 from moving backwards and forwards within the distribution chamber 370, the outer wall 320 and the guide plate 330 are supported with respect to one another in an area facing the tube block 350 by supporting studs 395, which, in the exemplary embodiment shown in FIG. 3, are integrated in the guide plate 330 and supported with respect to one another. However, the supporting studs may also equally well be integrated in the outer wall 320 or in both walls. Other supporting structures may include circumferential or interrupted rib or ribs or shaped attachments. Such support means may also be integrated with or connected to either the inner wall or outer wall.

Figure 4:
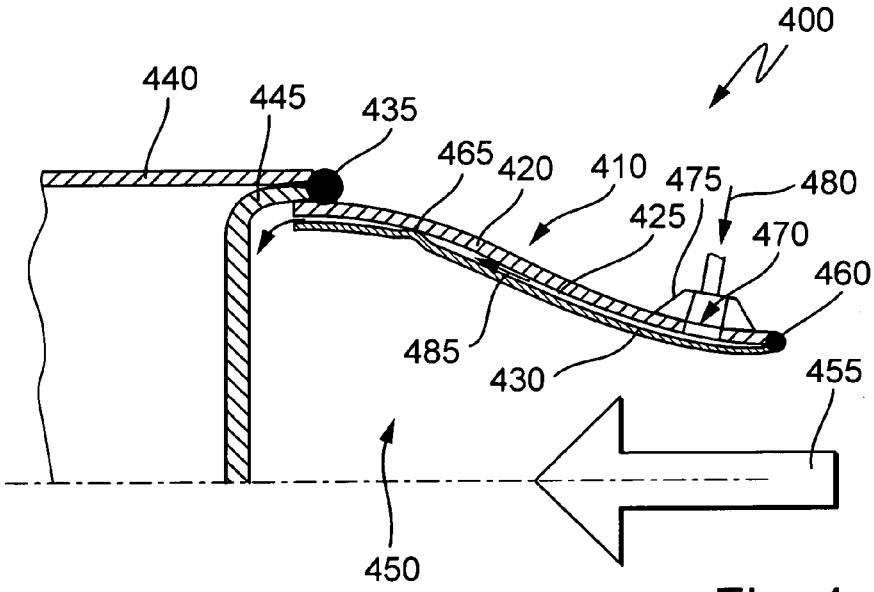
FIG. 4 is a cross-sectional view of a heat exchanger according to another embodiment of the present invention.

FIG. 4 is a cross-sectional view of a further exhaust gas cooler 400 according to another embodiment of the invention. A headpiece 410 once again comprises an outer wall 420 and an inner wall 430 in the form of a guide plate, between which a cavity 425 which is in the form of a gap is formed. As a result, a contact point 435 between the outer wall 420 and the tube block 440 or the tube base 445 is thermally isolated from exhaust gas 455 flowing into the distribution chamber 450.

The inner wall 430 and the outer wall 420 are welded to one another only in an area 460 which faces away from the tube block 440, and are supported with respect to one another in an area which faces the tube block 440 by supporting studs 465 which are integrated in the inner wall 430. The outer wall has an inlet opening 470, so that the cavity 425 which is in the form of a gap can have air 480 applied to it via a connecting flange 475.

The cavity 425, which communicates with the distribution chamber 450, is used as a flow channel which carries the air flow 485 between the outer wall 420 and the inner wall 430 into the distribution chamber 450. There, the air flow is mixed as indicated by the arrow 485 with the exhaust gas flow 455, so that an exhaust gas/air mixture which has already been pre-cooled enters the tube block 440. Thus, overall, the exhaust gas is cooled more effectively, and the performance of the exhaust gas cooler 400 is improved.

In order to ensure that the air 480 flows into the exhaust gas cooler 400, care must be taken to ensure that the pressure of the air 480 is higher than the pressure of the exhaust gas 455 in the distribution chamber 450. This may, for example, be compressed air or booster air, which is in each case compressed by an air feed device.

Figure 5:
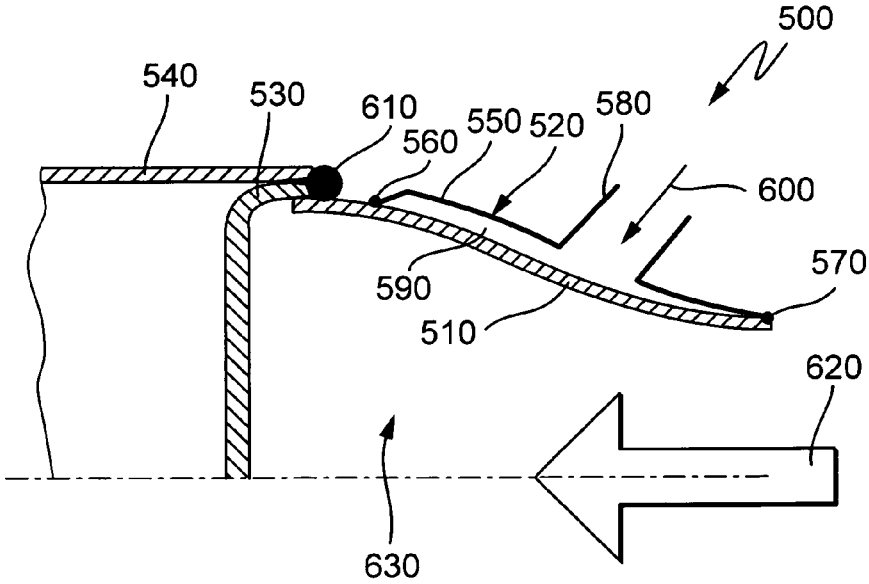
FIG. 5 is a cross-sectional view of a heat exchanger according to still another embodiment of the present invention.

FIG. 5 is a cross-sectional view of an exhaust gas cooler 500 according to another embodiment of the invention. In this case, an inner wall 510 from a headpiece 520 is welded to a tube base 530 and to the tube block 540. An outer wall 550 is attached, for example, welded, in a liquid-tight manner to the inner wall 510, both in an area 560 which faces the tube block 540 and in an area 570 which faces away from the tube block 540.

Furthermore, the outer wall 550 has a connecting stub 580 for a coolant inlet, and a further connecting stub, which is not shown, for a coolant outlet. In consequence, the coolant 600 in a cooling circuit flows through the channel 590 which is formed by the cavity between the inner wall 510 and the outer wall 550.

Although, in this exemplary embodiment, the contact point 610 between the headpiece 520, the header plate 530 and the tube block 540 is located directly in the hot exhaust gas flow 620 in the distribution chamber 630, the temperature difference between the headpiece 520 and the tube block 540 is reduced by the cooling effect of the coolant 600. This reduces the mechanical load on the contact point 610, and hence also the risk of leaks. Furthermore, the additional cooling of the exhaust gas 620 improves the performance of the exhaust gas cooler 500.

The present invention has been described using the example of an exhaust gas cooler for a motor vehicle. However, it should be noted that the heat exchanger according to the invention is also suitable for other similar applications.

Although the invention has been described in terms of several preferred embodiments, it will be appreciated that various modifications and altercations might be made by those skilled in art without departing from the spirit and scope of the invention.

What is claimed is:

1. A motor vehicle heat exchange system comprising:

an internal combustion engine;

a heat exchanger arranged in fluid communication with the internal combustion engine, the heat exchanger comprising (a) a plurality of tubes through which a first fluid can flow and around which a second fluid can flow, and (b) a header compartment which comprises an outer wall and which is arranged to receive the first fluid from the internal combustion engine and distribute the first fluid to the plurality of tubes, at least a portion of the header compartment comprising both an inner wall and said outer wall, wherein the inner wall and the outer wall (i) are arranged to form a cavity which is in fluid communication with the plurality of tubes or (ii) define at least a portion of a fluid flow path between an opening in the outer wall and the plurality of tubes for a third fluid, and wherein the inner wall and the outer wall are supported with respect to each other by stud-like embossed areas.

2. The motor vehicle heat exchange system of claim 1, wherein the stud-like embossed areas are integrated in the inner wall.

3. The motor vehicle heat exchange system of claim 1, wherein the stud-like embossed areas are integrated in the outer wall.

4. The motor vehicle heat exchange system of claim 1, wherein the stud-like embossed areas are integrated in both the inner wall and the outer wall.

* * * * *